United States Patent [19]

Lovett

[11] Patent Number: 4,864,757

[45] Date of Patent: Sep. 12, 1989

[54] PORTABLE KIT FOR ERECTING SIGN WITH RIGID PANEL

[76] Inventor: Terry E. Lovett, 911 Veronica Dr., Huntington Beach, Calif. 92647

[21] Appl. No.: 226,690

[22] Filed: Aug. 1, 1988

[51] Int. Cl.[4] ..... G09F 7/18

[52] U.S. Cl. ..... 40/607; 40/605; 40/611; 40/606; 24/561

[58] Field of Search ..... 40/584, 603–607, 40/609–611; 248/447.2, 451; 24/561–563

[56] References Cited

U.S. PATENT DOCUMENTS

| | | | |
|---|---|---|---|
| 1,868,726 | 7/1932 | Collier | 24/561 |
| 2,045,378 | 6/1936 | Austin | 40/607 |
| 2,048,359 | 7/1936 | Snell | 40/611 |
| 2,580,948 | 1/1952 | Pancake | 40/606 |
| 2,790,258 | 4/1957 | Freshour | 40/610 |
| 2,849,817 | 9/1958 | Krayer | 40/609 |
| 3,525,493 | 8/1970 | Chrietzberg et al. | 40/606 |
| 4,115,966 | 9/1978 | DeLee | 40/607 |
| 4,452,416 | 6/1984 | Templeton | 40/606 |

*Primary Examiner*—Richard J. Apley
*Assistant Examiner*—J. Welsh
*Attorney, Agent, or Firm*—Fulwider, Patton, Rieber, Lee & Utecht

[57] ABSTRACT

A portable sign kit includes components for quickly and conveniently erecting lightweight signs, e.g. real estate sales and similar signs. The components include an open wire frame with a prejecting mounting stud. A rigid sign panel is received within the periphery of the frame. The rigid panel is retained within the frame by specially shaped moldings which snappably attach to the frame sides and extend inwardly to retain corresponding abutting edges of the rigid sign panel.

1 Claim, 1 Drawing Sheet

PORTABLE KIT FOR ERECTING SIGN WITH RIGID PANEL

This invention is an improvement upon the apparatus disclosed in my co-pending application Ser. No. 7/107,509.

The invention relates to a kit for storing, transporting and facilitating erection of a plurality of signs.

More particularly, the invention concerns such a kit which is specially adapted for use by residential real estate sales persons to locate and identify an open house by means of a plurality of signs spaced along roads and streets in the area of the house.

Even more particularly, the invention pertains to such a kit which is easily and conveniently used by persons of limited strength and mechanical skills.

In still another and further respect the invention concerns such a kit which permits convenient and economical replacement of various elements of the sign which have been mechanically damaged, weathered or which become obsolete.

According to conventional practice in the residential real estate sales industry, selected specific houses which have been listed or advertised for sale by a real estate company are periodically opened for inspection by potential purchasers. These potential purchasers may be specific referrals or may simply be members of the general public who happen to be in the area of the so-called "open house".

In either case, it is important to easily identify the location of the open house and this is easily accomplished by placing several signs along streets in the residential neighborhood and at the intersections of these residential streets with major thoroughfares. For example, in a typical situation, upwards of five or even ten of these signs are strategically placed to draw attention to the fact that there is an open house in the area and to easily lead prospective purchasers to it.

A very large portion of the real estate sales persons who are assigned to "sit" these open houses are persons of limited strength and often of limited mechanical skills. Consequently, the storage, transportation and erection of these signs at the appropriate locations is considered an onerous and very disagreeable task. This problem becomes even more severe when the open house signs have to be removed, transported, stored and then replaced each day that the open house is available for inspection.

Until now, the open house signs conventionally employed by real estate sales persons have been cumbersome, heavy and sometimes even dangerous to handle. Furthermore, such signs are constantly the target of vandals and rapidly become unsightly through mechanical damage, weathering and normal handling The above-described problems are actually so severe that highly competent and skilled real estate sales persons, which real estate sales companies compete to employ, have actually selected or changed employers because of minor advantages or disadvantages in the specific types of prior art open house signs used by their various prospective employers.

Prior art open house signs which are typically employed in the residential real estate sales industry are generally fairly expensive because they are too bulky to permit long-distance shipment from a common manufacturer. Such signs typically consist of stiff metal or wooden panels, painted with advertising logos and messages, and affixed by means of bolts, screws or other semi-permanent fasteners to relatively long ground posts or bulky collapsible tripods, A-frames and the like. These signs cannot be economically shipped for long distances and must normally be produced locally in comparatively small quantity with attendant higher unit manufacturing costs.

The closest prior art, of which I am aware, is the U. S. Pat. No. 4,259,803, issued Apr. 7, 1981 to Edwin C. Sittler, entitled "Portable Sign". The Sittler sign consists of a plurality of vertically spaced horizontal tubular cross members which are received in sockets carried on the upper portion of a vertical post. A folded sign, the faces of which are backed by vertical stiffening members, is draped over and supported by the uppermost cross member.

It would be highly desirable to provide a kit for storing, transporting and facilitating the erection of a plurality of lightweight, disassemblable, ruggedly constructed, yet relatively inexpensive signs which are specially adapted for use by residential real estate sales persons to locate and identify an open house. Further, it would be desirable to provide a kit for such signs which can be easily carried by one person of limited physical strength, which can be stored conveniently in a conventional automobile trunk space, and which can be used to rapidly and conveniently erect such signs, each having a minimum of separate parts, without requiring substantial physical strength or mechanical skill.

It would also be desirable to provide a kit for 4 constructing such signs in which elements which are damaged or which deteriorate from weathering, etc., can be quickly and conveniently replaced.

It would also be desirable to provide such a kit in which the sign message is carried on a rigid sign panel which can be formed of an opaque material and which can be conveniently and economically printed by conventional printing techniques, to provide an attractive finished sign which is quickly and conveniently assembled and disassembled by persons of little or no mechanical skill without using any hand tools.

Accordingly, it is the principal object of the present invention to provide a kit for storing, transporting and erecting signs.

Yet another object of the invention is to provide such a kit which can be conveniently and quickly stored, transported and used for erecting such signs by persons of limited physical strength and mechanical skills. Yet another object of the invention is to provide such a kit which can be used to construct signs which are lightweight but of substantial mechanical strength and which can be less expensively manufactured or repaired than prior art signs.

These and other, more specific objects and advantages of the invention will be apparent to those skilled in the art from the following detailed description thereof, taken in conjunction with the drawings, in which.

Briefly, in accordance with the invention, I provide a kit for storing, transporting and facilitating erection of a plurality of signs which are specially adapted for use by residential real estate sales persons to locate and identify an open house. The kit includes disassemblable elements for constructing and erecting at least one such sign. These elements include a generally rectangular open continuous wire frame, a support stud affixed to a side of said frame, a rectangular rigid sign panel, a pair of deformable elongate moldings for holding the rigid sign within the open wire frame and means for mounting the assembled frame and sign panel on a vertical support. The deformable moldings have a generally U-shaped cross-section. Inner opposed surfaces of each molding have opposed elongate grooves formed therein. The moldings are shaped and dimensioned to be snappably affixed to opposed sides of the open wire frame by receiving the frame sides in the opposed grooves. The legs of the U-shaped molding extend inwardly within the frame periphery to retain corresponding abutting edges of the sign panel between the legs of the U-shaped molding.

Figure 1:
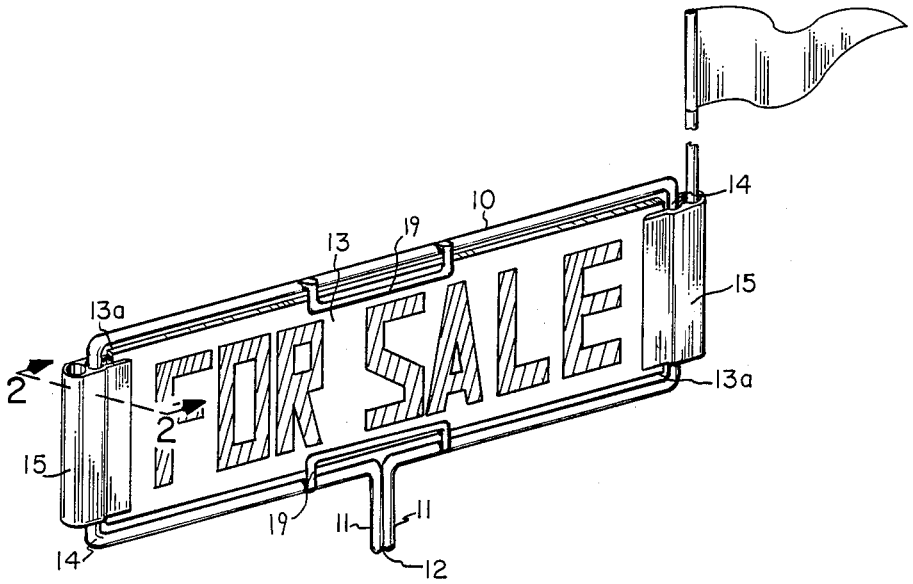
FIG. 1 is a perspective view of a sign constructed of the elements of a kit in accordance with the presently preferred embodiment of the invention.
Figure 2:
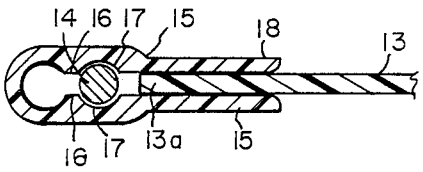
FIG. 2 is a sectional view of the sign of FIG. 1, taken along section line 2—2 thereof.

Turning now to the drawings, in which like reference characters identify the same elements in the several views, kit components are provided to construct a sign as in FIG. 1 which includes an open wire frame 10 formed of a piece of continuous wire or rod of suitable stiffness. Ends 11 of the frame rod 10 are bent away from the sign at one side to provide a support stud 12. A rigid rectangular sign panel 13 is provided which is shaped and dimensioned to be received within the frame 10 with at least two opposed edges 13A thereof abutting corresponding opposed sides 14 of the frame 10. Preferably, means are provided to stabilize the center portion of the sign panel 13 against bending in directions perpendicular to the panel 13. For example, suitable wire supports 19 can be welded to the top and bottom of the open wire frame 10, on both sides of the space provided for the panel 13. A pair of deformable elongate moldings 15 are provided having a generally U-shaped cross-section as shown in FIG. 2. The inner opposed surfaces 16 of each molding 15 are provided with opposed elongate grooves 17. The moldings are shaped and dimensioned to be snappably affixed to corresponding sides 14 of the frame 10 by receiving the frame sides 14 in the opposed grooves 17. The legs 18 of the U-shaped molding 15 extend inwardly of the frame to retain abutting edges 13A of the sign panel therebetween.

Figure 3:
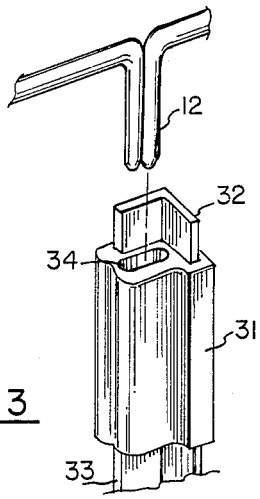
FIG. 3 illustrates the mounting of the sign of FIG. 1 on an angle post driven into the ground.
Figure 4:
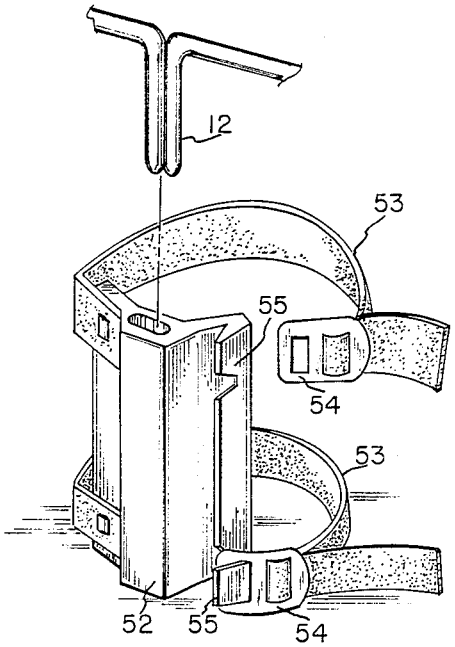
FIGS. 4 and 5 illustrate mounting the sign of FIG. 1 on an existing vertical support, e.g., a tree.

The sign of FIGS. 1–2 can be conveniently mounted by supporting the mounting stud 12 in any suitable fashion, for example, as shown in FIGS. 3–4. FIG. 3 illustrates use of a specially shaped resilient molding 31 which is carried on the end 32 of a vertical angle stake 33 driven in the ground (not shown). The stud 12 is received in a mating channel 34 formed in the molding 31.

Figure 5:
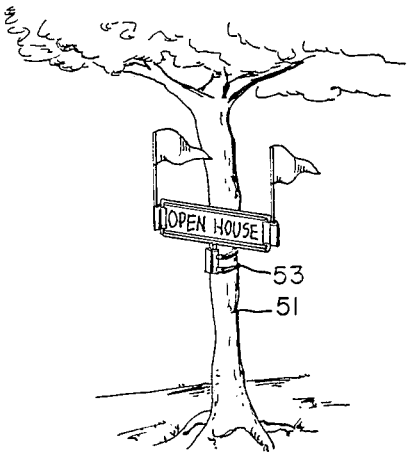

Similarly, the sign of FIGS. 1–2 can be mounted on an existing vertical support, e.g., a tree 51 (as shown in FIGS. 4–5). In this embodiment, a special molding 52 is provided with elongate straps 53, the free ends of which can be attached by buckles 54 to mating projections 55. The resulting assembly of the sign of FIGS. 1–2 and the support of FIG. 4 can be conveniently attached to a tree or other vertical support 51 by means of straps 53, as shown in FIG. 5.

Having described my invention in such terms as to enable those skilled in the art to understand and practice it, and having identified the presently preferred embodiment thereof, I claim:

1. A kit for storing, transporting and facilitating erection of a plurality of signs specially adapted for use by residential real estate sales persons to locate and identify an open house, said kit comprising disassemblable elements for constructing and erecting at least one such sign, said sign comprising:

(a) a generally rectangular open continuous wire frame;

(b) a support stud affixed to a side of said frame;

(c) a rectangular rigid sign panel shaped and dimensioned to be received within said frame with at least two opposed edges thereof abutting corresponding opposed sides of said frame;

(d) a pair of deformable elongate moldings having a generally U-shaped cross-section, the inner opposed surfaces of which have opposed elongate grooves formed therein, said moldings being shaped and dimensioned to be snappably affixed to said corresponding sides of said frame by receiving said frame sides in said opposed grooves, with the legs of said U-shaped molding extending inwardly within said frame to retain said abutting edges of said sign panel therebetween; and (e) means for mounting said frame and sign panel on a vertical support.

* * * * *